US005910324A

United States Patent [19]

Koch

[11] Patent Number: 5,910,324

[45] Date of Patent: Jun. 8, 1999

[54] DEVICE FOR THE MANUFACTURE OF TABLETS

[75] Inventor: Rudolf Koch, Bad Tölz, Germany

[73] Assignee: Courtoy NV, Halle, Belgium

[21] Appl. No.: 08/894,541

[22] PCT Filed: Dec. 12, 1996

[86] PCT No.: PCT/EP96/05569

§ 371 Date: Aug. 21, 1997

§ 102(e) Date: Aug. 21, 1997

[87] PCT Pub. No.: WO97/23347

PCT Pub. Date: Jul. 3, 1997

[30] Foreign Application Priority Data

Dec. 22, 1995 [DE] Germany ..... 295 20 473 U

[51] Int. Cl.[6] ..... B30B 11/08; B30B 15/30

[52] U.S. Cl. ..... 425/345; 425/257; 425/348 R; 425/353; 425/354; 425/434

[58] Field of Search ..... 425/259, 345, 425/348 R, 352, 353, 354, 355, 434, 257

[56] References Cited

U.S. PATENT DOCUMENTS

| | | | |
|---|---|---|---|
| 852,457 | 5/1907 | Schorr | 425/345 |
| 1,448,982 | 3/1923 | Treadwell . | |
| 4,403,935 | 9/1983 | Crossley et al. | 425/345 |
| 4,943,227 | 7/1990 | Facchini | 425/345 |
| 5,240,401 | 8/1993 | Derckx | 425/345 |

FOREIGN PATENT DOCUMENTS

| | | |
|---|---|---|
| 0037689 | 10/1981 | European Pat. Off. . |
| 352070 | 8/1905 | France . |
| 2397227 | 2/1979 | France . |
| 2625461 | 7/1989 | France . |
| 1070587 | 6/1967 | United Kingdom . |

OTHER PUBLICATIONS

WPI/Derwent Database AN 82–47436D & SU 770 836 (Oct. 16, 1980).

*Primary Examiner*—Harold Y. Pyon
*Assistant Examiner*—Joseph Leyson
*Attorney, Agent, or Firm*—Dilworth & Barrese

[57] ABSTRACT

The invention relates to a device for the manufacture of tablets or compacts with at least two compacting tools which in each case can be moved in relation to one another and at least one template interacting with these and with a filling arrangement to feed the tabletting material into the template. In accordance with the invention, the compacting tools movable in relation to one another are aligned horizontally.

15 Claims, 5 Drawing Sheets

DEVICE FOR THE MANUFACTURE OF TABLETS

BACKGROUND OF THE INVENTION

The invention relates to a device for the manufacture of tablets or compacts in accordance with at least two compacting tools which, in each case, can be moved in relation to one another and at least one template interacting with these and with filling means to feed the tabletting material into the template.

Automatic devices for the manufacture of tablets are based on the principle that a tabletting material is pressed to a tablet by means of a compacting process. For this purpose, two moving punches serve as compacting tools. Known automatic devices for the manufacture of tablets possess a bottom punch in vertical alignment which works in a template and a top punch which is led into the template only for compacting. The top punch slides into the template, pushes the powder together and compacts the tablet. The thickness, firmness and compacted gloss of the tablet depend on said top punch and its compacting pressure. The depth of insertion and the amount of pressure can be adjusted. The bottom punch is located in the template. It limits the pot towards the bottom. During the compacting process it as a rule forms the pressure sustaining part. At the end of compacting, it is led upwards and so moves the tablet to the template edge where it is pushed to the side. In the next cycle, the bottom punch returns to its start position and the template pot is ready to accept the next filling. The filling of the template is performed via a filling funnel whose bottom part is termed a filling shoe.

These known devices are as a rule today designed as concentric tabletting machines. In these types, the filling shoe of the filling funnel is stationary while the template is movable. A round horizontal plate supports a number of templates. As described above, each template has its own top and bottom punch. The punches are raised or lowered via rollers. By turning a horizontal plate, the templates are moved one with their punches after the other into the position ready for filling underneath the filling shoe.

Concentric tabletting machines possess a number of serious defects due to their process technology which cannot be eliminated completely due to the design principle of the device described above. Here, the following disadvantages are of most significance in the manufacture of tablets for pharmaceutical purposes or also of compacts in the food sector:

- An intensive pre-treatment of the substances to be compacted is necessary in order to obtain good flow behavior and dosing capability.
- The filling principle (fixed filling shoe on a rotating template table) means that relatively high material loss has to be accepted and that, for example, metal rubbings enter into the product to be made through the seal rails to be provided on the filling shoe. The so-called black spots are created on the table surface.
- Dust created in the compacting pot of the device is first deposited on the free surfaces of the greased top punch. As the process continues, it falls off and enters into the filling shoe through the template table. This effect also leads to the already mentioned "black spots" on the tablet surface.

SUMMARY OF THE INVENTION

It is therefore the object of the invention to provide a device for the manufacture of tablets or compacts with which tablets or compacts can be manufactured without the so-called "black spots" on the tablet surface.

This object is solved on the basis of a device of the type specified in accordance with compacting tools movable in relation to one another being aligned horizontally. In accordance with this, the basic idea to solve the invention is in contrast to the whole prior art to align the compacting tools which can be moved relative to each other no longer vertically, but horizontally. In this way, the occurrence of the "black spots" can be effectively avoided.

Perferably, the compacting tools are positioned on a rotor which can be set into rotary motion. Here, multiple compacting tool pairs which pair parts are movable in relation to each other can be arranged at equal distances on the circumference of the rotor. The filling means can be coupled with the rotor in such a way that it can be set into rotary motion together with the rotor. Here, the rotor and filling means can be coupled to each other via the axle of rotation. The filling means can comprise a filling funnel formed in a convex design onto which tapering channels are set in a funnel design the tapered ends of which channels open into a filling aperture of the relevant template. This arrangement of the filling funnel allows the templates to be filled with the tabletting material by means of centrifugal force. In this way, even poorly flowing materials can be processed well and a more precise dosing is possible.

Advantageously, the compacting tools which are movable in relation to each other are moved in a horizontal direction during their rotation through guide curves associated with each of them. In this way, at certain angle positions a correspondingly associated work cycle can be performed. A pressure roller can be supported eccentrically to the axis of rotation of the rotor and at the end of the rotating part of the device, two further pressure rollers can be located so that via the eccentric pressure roller and the two further pressure rollers the pressing tools which are positioned between them during the corresponding passage can be pressed against one another. These two further pressure rollers can be located at a different distance to the associated compacting tools in such a way that a compacting pressure with different force can be generated. In this way, at a certain angle position, pre-compacting can be ensured by a first pressure roller and at a second angle position, full compacting can be performed by the second pressure roller.

BRIEF DESCRIPTION OF THE DRAWINGS

Further details and advantages of the invention are described in more detail by means of an embodiment shown in the drawings in which.

DESCRIPTION OF THE PREFERRED EMBODIMENTS

Figure 1:
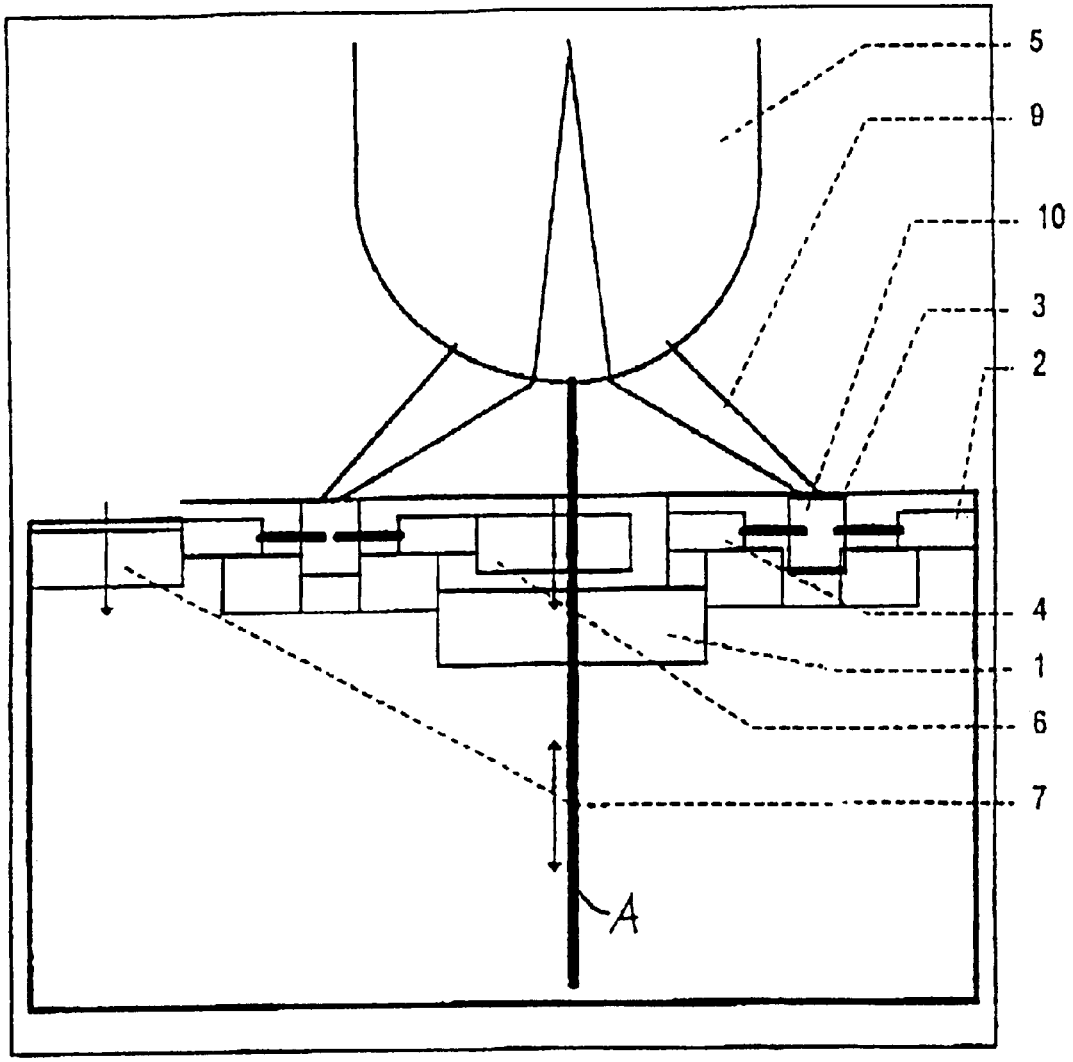
FIG. 1 shows a schematic section through one part of a first embodiment of the device in accordance with the invention.
Figure 2:
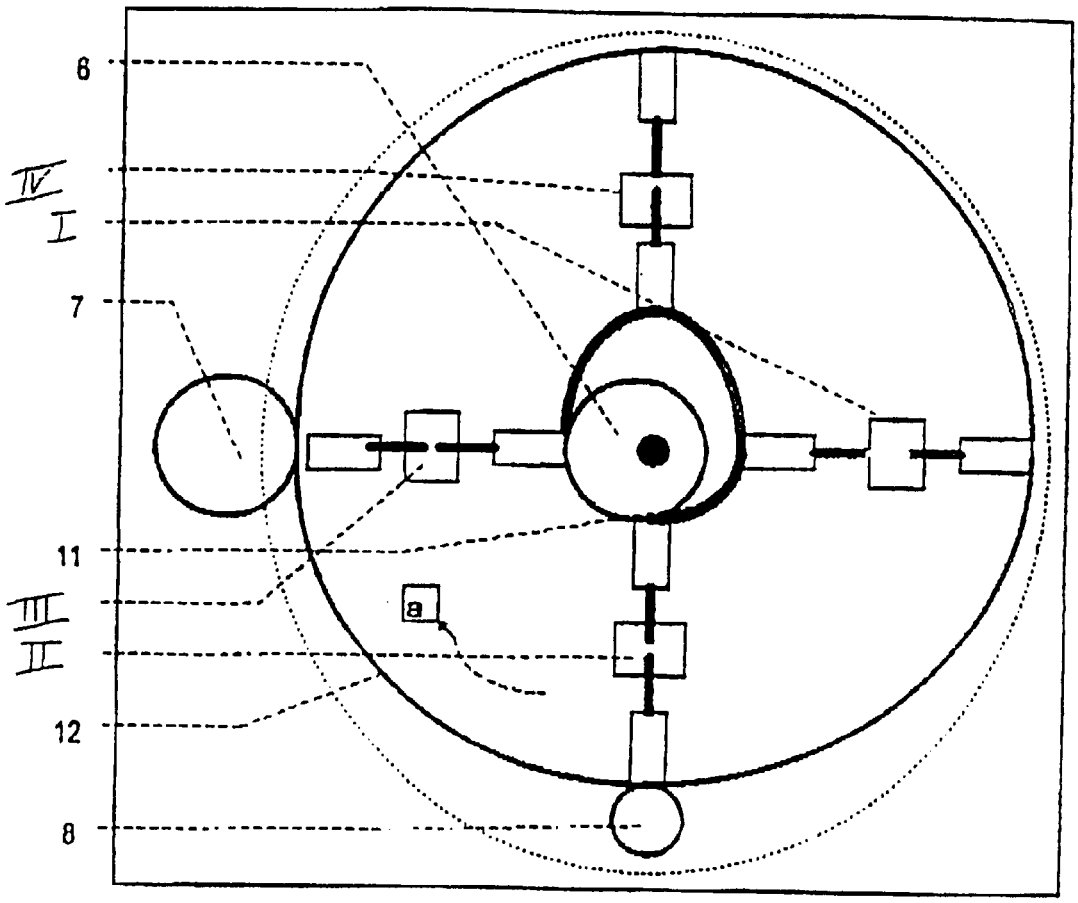
FIG. 2 illustrates a top view of a part of the device in accordance with the invention in accordance with FIG. 1.

The device shown in FIGS. 1 and 2 possesses a rotor 1 driven by a motor not shown in any detail here which rotor can be set into rotary motion in rotating direction a in accordance with FIG. 2. On this rotor, in horizontal alignment, are fitted two compacting tools 2, 4 which in each case are movable in relation to one another. The compacting tools 2, 4 are designed in the form of an inner punch 4 and an outer punch 2 which dip into a corresponding borehole of a template 3. On the circumference of the rotor 1 in the present embodiment, are located four compacting tool pairs which interact with the corresponding templates. On a central axle A of the rotor 1 there is additionally positioned a material filling funnel 5 which rotates together with the rotor 1. As the rotor I rotates, the outer compacting tool 2, the outer punch, is moved over an outer guide curve 12 (FIG. 2) in a horizontal plane relative to the rotor 1. Equally, the second compacting tool 4, the inner punch, is moved over a guide curve 11 in the horizontal plane of the rotor as the rotor 1 rotates. In this way, the compacting tools 2 and 4 take on a different position to one another in dependence on the angle position of the rotor 1 due to the corresponding guide curves. This is made clear by means of the representation in accordance with FIG. 2.

In position I, the two compacting tools are at a large distance from one another. Here, the tabletting material is filled in and dosed. In position II, the compacting tools 2 and 4 are moved closer to one another. Here the tabletting material is increasingly compressed. To apply the required compacting force, two pressure rollers 6 and 8 are positioned opposite each other here. In this position, the pre-compacting of the tablet or compact is performed within template 3. In position III, the compacting tools 2 and 4 are moved even closer together so that the tabletting material is compressed even further. Here the final compacting pressure to form the tablet is achieved. The final compacting pressure is applied by the pressure roller 6 and the pressure roller 7 (FIG. 2). Finally, the compacting tools are moved by the curve control in such a way that the finished tablet or compact is ejected from the template. This ejection position is marked by IV in FIG. 2.

The pressure rollers 6, 7 and 8 are designed to be movable. The pressure roller 6 positioned in the central area of the rotor 1 is located eccentrically to the axle A of the rotor 1 here and is adjustable in its eccentricity. The pressure rollers 7 and 8 are each adjustable in their distance to the rotor 1. Thanks to this adjustability, the compacting forces to form the tablet or compact can be varied. Basically, the pressure rollers 6, 7 and 8 serve, as described above, to generate the required compacting forces and to transfer these to the compacting tools. In this process, at each passage of the compacting tool pair 2, 4 between the pressure rollers 6 and 8 and 6 and 7 associated therewith in each case, a packing of the template contents takes place.

The filling means 5 in the embodiment shown here is designed as a filling funnel with a convex design, with the funnel shape being obtained by a cone located in the interior of the filling funnel. Funnel-like tapering channels 9 are formed between the filling funnel 5 and corresponding filling apertures 10 in the templates 3. Due to the centrifugal forces which apply to the tabletting material particles located in the tapering ends as a result of the rotation of the filling funnel, a safe transport and so filling of the templates 3 is ensured at position I.

Figure 3:
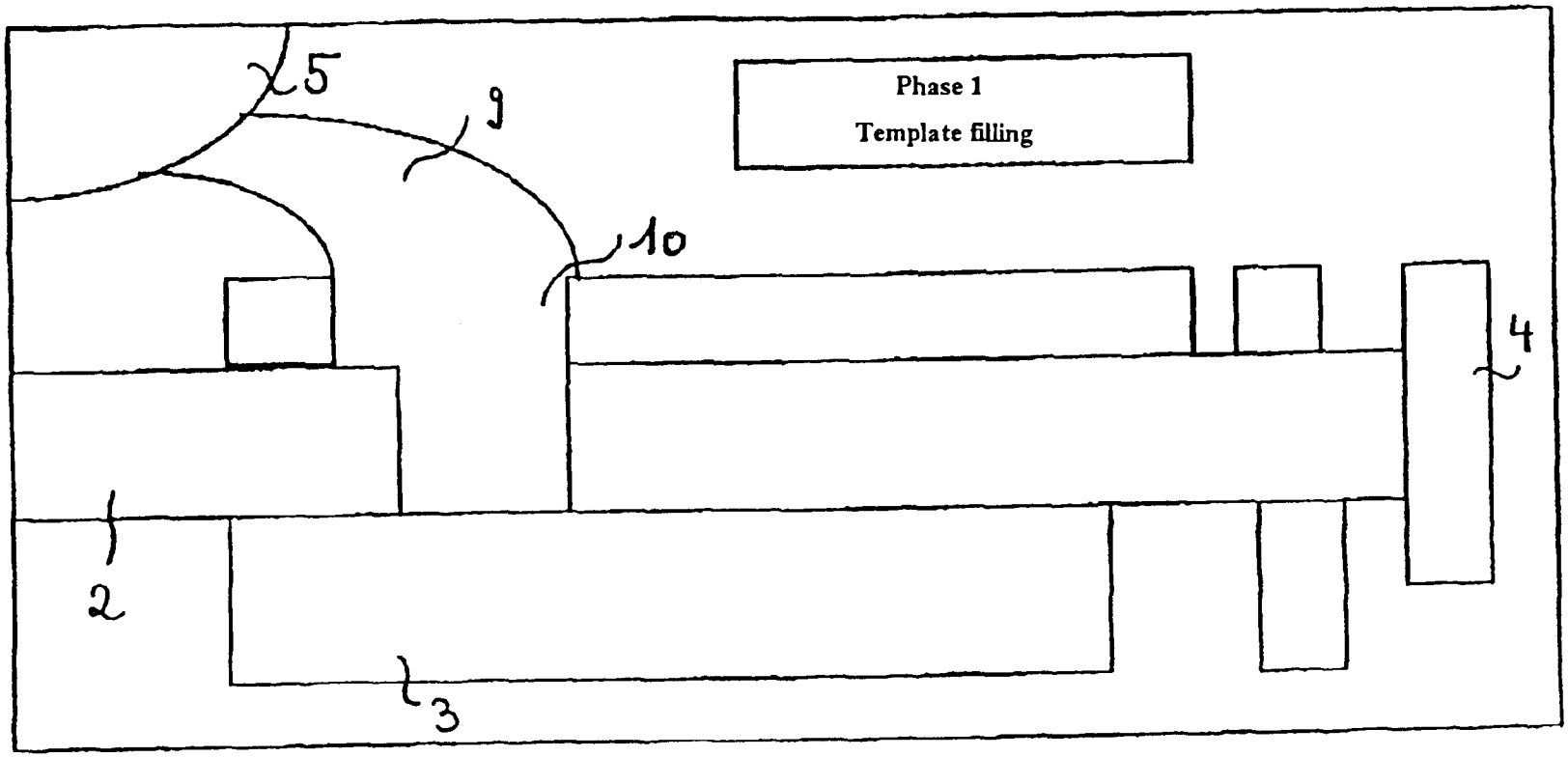
FIGS. 3–5 illustrate detailed representations which explain different worksteps of the device in accordance with the invention.
Figure 4:
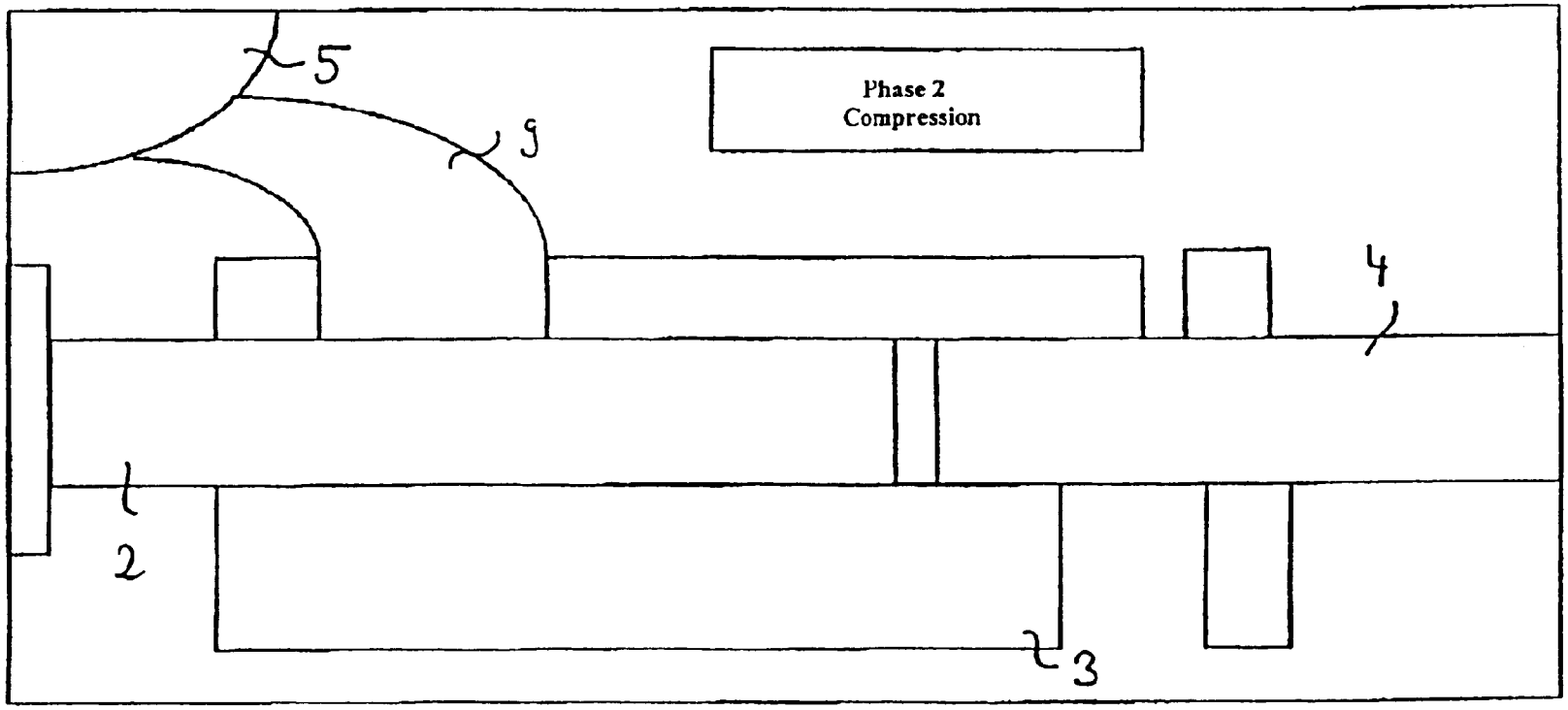
Figure 5:
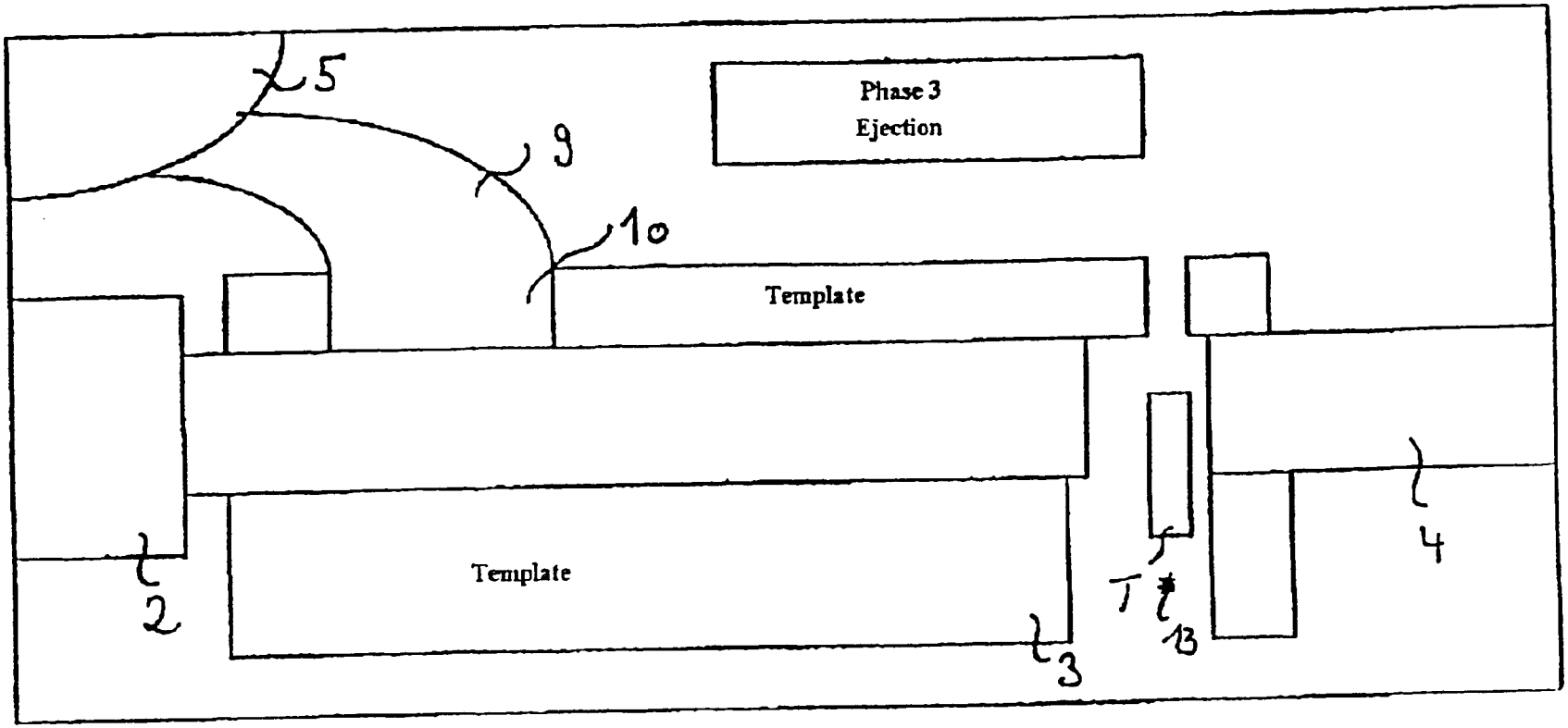

In FIGS. 3 to 5, different working positions of the compacting tools 2 and 4 in relation to each other are shown in each case. In FIG. 3, the phase of template filling is shown. This representation corresponds to position I in FIG. 2. In FIG. 4, the compression of the tabletting material is shown. This phase 2 corresponds to positions II and III of FIG. 2. Finally, FIG. 5 shows the ejecting of the finished tablet T. Phase 3 corresponds to position IV in FIG. 2. It becomes clear here that the finished Tablet T can fall down due to gravity through a corresponding slot 13 into a collecting box not shown in any detail here.

I claim:

1. A device for the manufacture of tablets or compacts with at least two compacting tools which define a compacting tool pair and which, in each case, are movable in relation to one another and at least one template interacting with these and with filling means to feed tableting or compacting material into the template, wherein the compacting tools are movable in relation to one another and are aligned horizontally, the compacting tools are both positioned on a rotor which is arranged to be set into rotary motion, on a circumference of the rotor, a plurality of said compacting tool pairs movable in relation to one another are positioned at equal distances and define inner and outer compacting tools, a pressure roller is located eccentrically to an axle of rotation of the rotor, and at an edge of a rotating part of the device, two further pressure rollers are located such that via the eccentric pressure roller and these two further pressure rollers, the compacting tools located therebetween are pressable against each other during corresponding passage.

2. A device in accordance with claim 1, wherein the filling means is coupled with the rotor in such a way that it is able to be set into rotaly motion together with said rotor.

3. A device in accordance with claim 2, wherein the rotor and the filling means are coupled together via an axle of rotation.

4. A device in accordance with claim 1, wherein the filling means comprises a filling funnel formed in a convex design on which tapering channels are fitted whose tapered ends open into a filling aperture of the template.

5. A device in accordance with claim 1, wherein the compacting tools movable in relation to one another are arranged to move in a horizontal direction during rotation by each said tool.

6. A device in accordance with claim 1, wherein the two further pressure rollers are adjustably located at a different distance to the associated compacting tools in such a way that a compacting pressure is able to be generated with different force.

7. A device in accordance with claim 3, wherein the filling means comprises a filling funnel formed in a convex design on which tapering channels are fitted whose tapered ends open into a filling aperture of the template.

8. A device in accordance with claim 7, wherein the compacting tools movable in relation to one another are arranged to move in a horizontal direction during rotation by guide curves associated with each said tool.

9. A device in accordance with claim 2, wherein the filling means comprises a filling funnel formed in a convex design on which tapering channels are fitted whose tapered ends open into a filling aperture of the template.

10. A device in accordance with claim 4, wherein the compacting tools movable in relation to one another are arranged to move in a horizontal direction during rotation by guide curves associated with each said tool.

11. A device in accordance with claim 1, comprising four pairs of said inner and outer compacting tools and four corresponding boreholes in said template.

12. A device in accordance with claim 11, structured and arranged to provide said pairs of compacting tools in the following four positions:

(i) a first position in which a respective pair of said two compacting tools are at a large distance from one another so that the tabletting/compacting material is filled in and dosed in the respective borehole;

(ii) a second position in which said respective pair of compacting tools is moved closer to one another to compress the tabletting/compacting material and perform pre-compacting of the tabletting/compacting material within said template;

(iii) a third position in which said respective pair of compacting tools is moved even closer together to compress the tabletting/compacting material even further and apply a final maximum compacting pressure to form a tablet or compact; and (iv) a fourth position in which said respective pair of compacting tools is moved away from one another so that the finished tablet or compact is ejected from said template.

13. A device in accordance with claim 1, additionally comprising a slot positioned in said template at an appropriate position such that a finished tablet or compact falls through said slot due to gravity upon movement of said respective inner compacting tool to position the finished tablet or compact thereover upon completion of a tabletting or compacting cycle.

14. A device in accordance with claim 1, wherein a number of boreholes in said template and the number of said pairs of inner and outer compacting tools are equal.

15. A device in accordance with claim 1, wherein said template is mounted upon said rotor, in turn, mounted to rotate about a vertical axis.

* * * * *